US007955168B2

(12) United States Patent
Mendelsohn et al.

(10) Patent No.: US 7,955,168 B2
(45) Date of Patent: Jun. 7, 2011

(54) AMUSEMENT RIDE AND VIDEO GAME

(75) Inventors: Seth Mendelsohn, North Hollywood, CA (US); Paul Yanover, Los Angeles, CA (US); Terry Dobson, San Marino, CA (US); Roger Holzberg, Burbank, CA (US); Jeffrey Voris, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1748 days.

(21) Appl. No.: 11/165,991

(22) Filed: Jun. 24, 2005

(65) Prior Publication Data

US 2006/0293110 A1 Dec. 28, 2006

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl. ..... 463/2

(58) Field of Classification Search ..... 463/2
See application file for complete search history.

(56) References Cited

U.S. PATENT DOCUMENTS

| | | | | |
|---|---|---|---|---|
| 5,127,657 | A | 7/1992 | Ikezawa et al. | |
| 5,320,362 | A | 6/1994 | Bear et al. | |
| 5,382,026 | A | 1/1995 | Harvard et al. | |
| 5,462,275 | A | 10/1995 | Lowe et al. | |
| 5,785,592 | A | 7/1998 | Jacobsen | |
| 5,860,862 | A | 1/1999 | Junkin | |
| 5,906,542 | A | 5/1999 | Neumann | |
| 6,080,063 | A * | 6/2000 | Khosla | 463/42 |
| 6,155,927 | A | 12/2000 | Levasseur et al. | |
| 6,220,965 | B1 * | 4/2001 | Hanna et al. | 463/52 |
| 6,726,567 | B1 | 4/2004 | Khosla | |
| 6,758,754 | B1 | 7/2004 | Lavanchy et al. | |

* cited by examiner

*Primary Examiner* — David L Lewis
*Assistant Examiner* — Reginald A Renwick
(74) *Attorney, Agent, or Firm* — Farjami & Farjami LLP

(57) ABSTRACT

An amusement system has a first path extending through an amusement attraction. Vehicles moving along the path have simulated weapons. Riders in the vehicles shoot at targets along the paths or on the vehicles. A game play system allows remote players to participate in a concurrent simulation of an amusement park or theme park ride, activity or event as the amusement park or theme park ride, activity or event is occurring. The system gathers input from sensors located at the amusement park or theme park ride or activity or event, preprocesses this input, and transfers it to a computer system, which uses this input to create a concurrent simulation of the amusement park or theme park ride or activity or event. A remote game player can then interact with the concurrent simulation by providing input to the concurrent simulation through a user interface. This system combines the excitement of a highly interactive video game with the amusement park or theme park ride or activity or event. Remote game players may additionally compete against each other.

10 Claims, 11 Drawing Sheets

FIG. 1
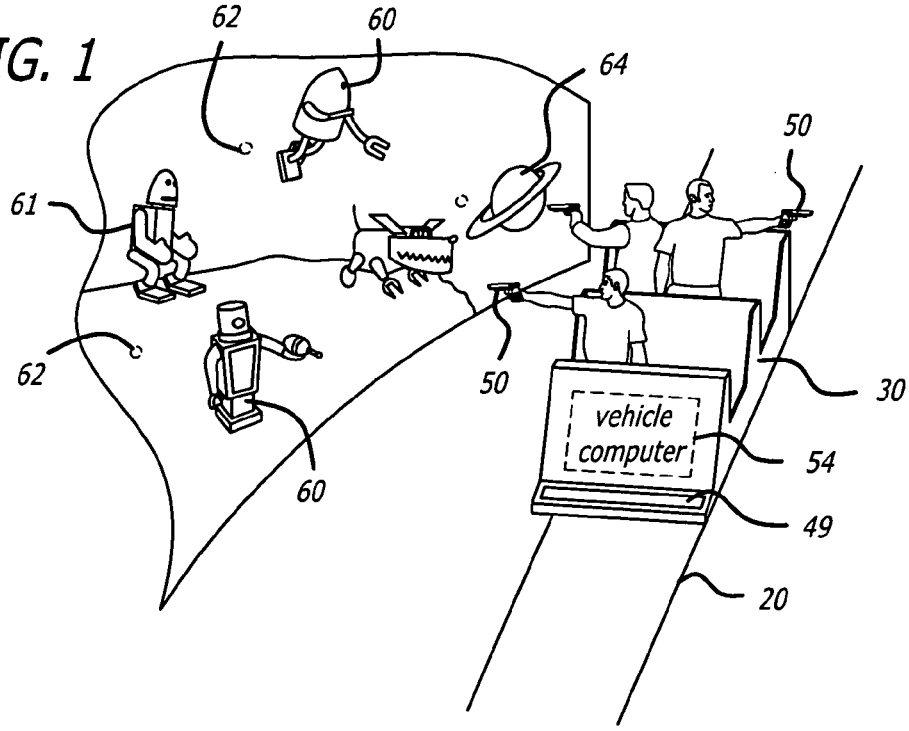
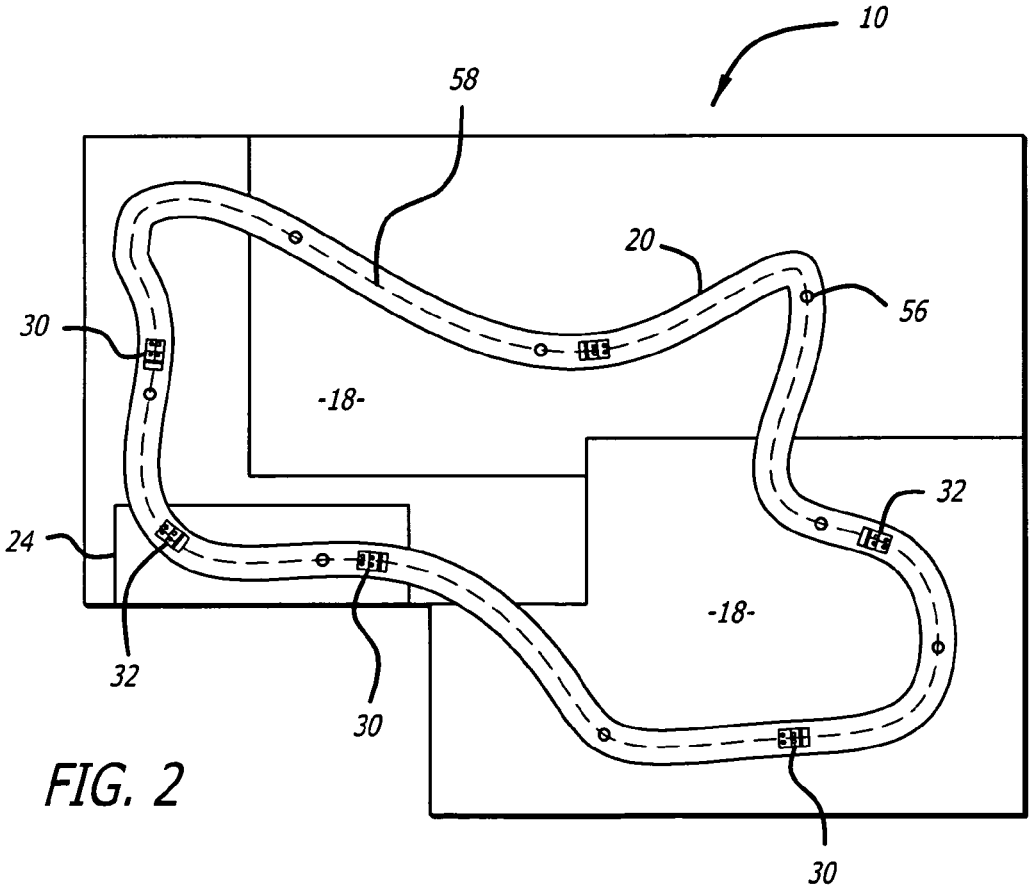
FIG. 2

FIG. 4
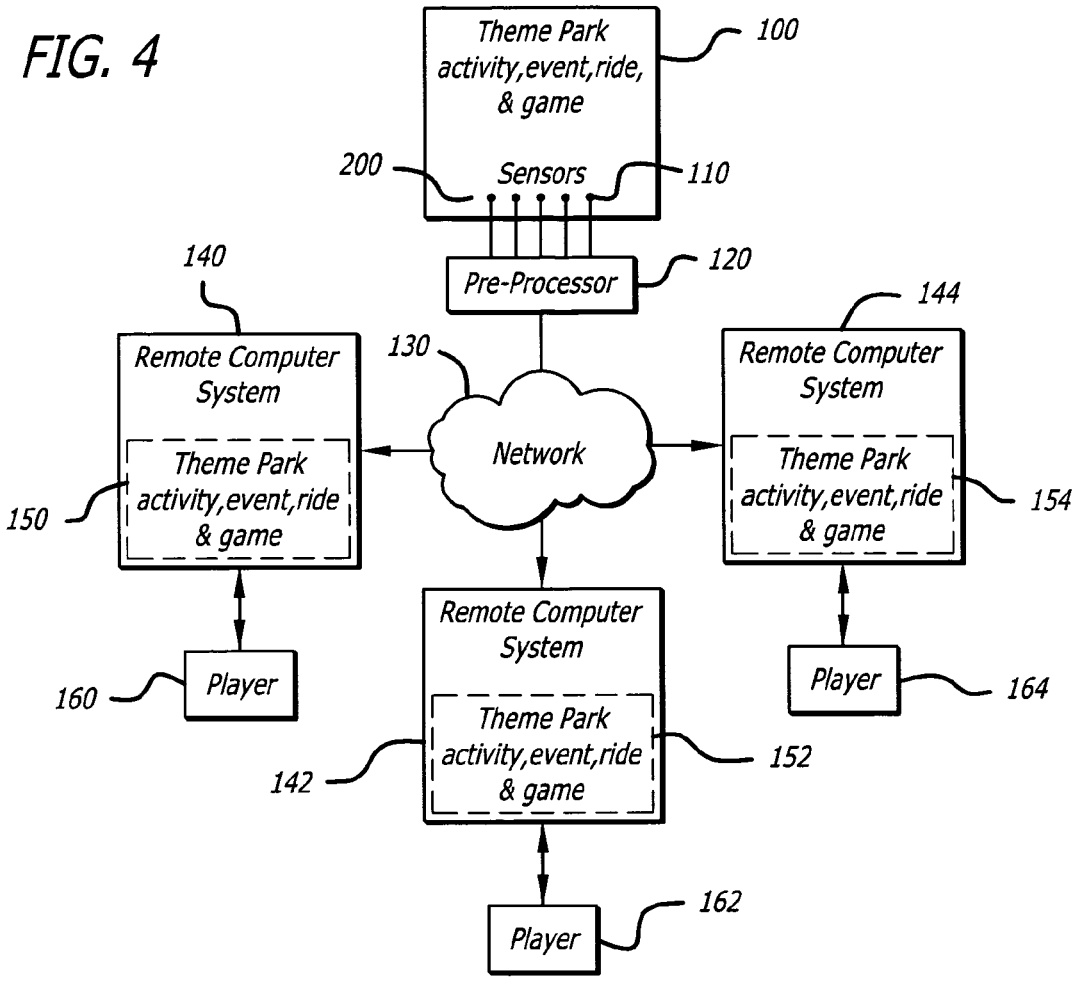
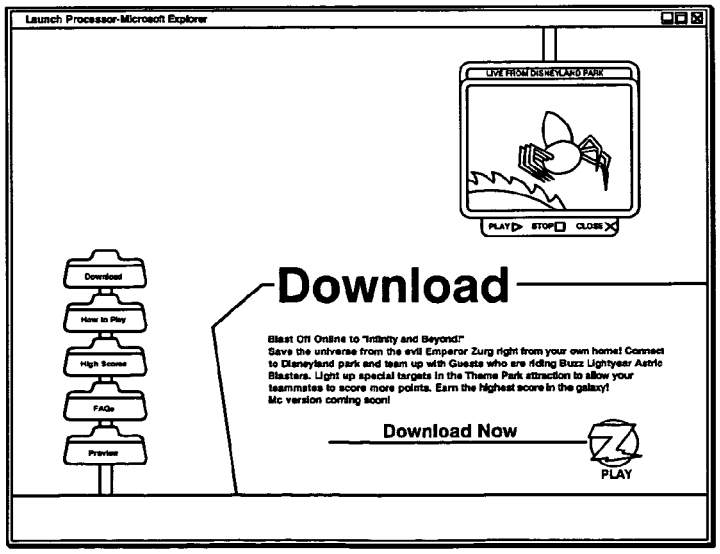
FIG. 5

AMUSEMENT RIDE AND VIDEO GAME

BACKGROUND

This disclosure relates to an amusement ride and video game. Both rides and video games provide entertainment to players through the excitement and thrills created in part by the movement of a ride vehicle through an attraction. Video games involving shooting are also popular games of skill.

Amusement rides and shooting games have been combined into amusement systems. Passengers sit in a vehicle, which moves through a ride attraction. The passengers are provided with simulated weapons, for shooting at various targets within the attraction. The simulated weapons typically project a light beam such as a laser beam, which is detected by sensors in the targets, and this defines a hit or other variation as determined by the rules of the amusement ride and game, which is part of the ride. Players accumulate points, rewards or the like.

Video games are a form of entertainment in a variety of forms, including: standalone video game systems, game cartridge systems connected to television sets, and video game software for personal computers. Simulated games typically allow a video game player to control the actions of a simulated participant on a video game screen by manipulating various knobs, buttons, joysticks, trackballs, and keyboards.

Video game players typically interact with and compete against simulated opponents on a simulated course, thereby setting an artificial standard of performance, which may be quite different from the standard of performance required to complete in a amusement park or theme park ride or activity competitive event. Rather than competing against each other directly, video game players typically compete against simulated opponents, and then compare scores against these simulated opponents with other video game players.

Some video games are played across multiple computers that are connected together by a computer network. These networks can connect geographically distributed computer systems linked by cross-country computer networks. These systems allow multiple players at individual computers to participate and compete in the same simulated video game. Players are able to compete against each other as well as simulated opponents. Although these systems allow video game players to directly compete against each other, they are generally competitive on the same video game platform, namely with the same criteria and the same video game environment.

There is a need to provide an enhanced entertainment experience for amusement ride participants and video game players.

SUMMARY

The present disclosure improves the experience of those participating in an amusement or theme park ride or event and those remotely located and participating through a video game relationship via a communication linkage. It provides enhanced experiences for remote players collectively and individually termed "at home" players of a video game, and for multiple at home players of the game.

The present disclosure relates to video games, computer simulations, computer networks, broadcast networks, and synchronization of distributed computing systems. In particular, the present disclosure relates to providing a computer-based system, which allows computer users at home to participate in a simulation of an amusement park event or ride at an amusement or theme e park at the same time participants are experiencing the amusement park activity at the park. Such simulation at home by computer is considered as taking place on a computer screen or system or television screen or system. Both such systems are collectively understood to be a computer system.

At an amusement park event or ride there are sensor systems that allow at home users to navigate through and selectively view a target location from a remote location. These sensor systems gather input from the activities taking place at the amusement park event or ride. Further, the sensor systems can include, for example, video cameras and microphones, located at target locations of the amusement park activity.

A communications network transfers these inputs to the at home players at remote locations. An at home player can then guide or interact with the amusement park ride or activity, for instance by guiding laser activities, video camera and other sensors located at the amusement park activity, and by otherwise manipulating the amusement park activity by action from controls at the remote location. A remote user navigates through and selectively views a target location in the amusement park activity from a remote location.

Such systems allow a remote user to facilitate simulated participation in the amusement park event that takes place at the amusement park.

The disclosure concerns interactive participation on different platforms been participants of a ride or an activity in an amusement park or theme park activity and those at home. Further, there can be interaction between multiple participants at home and the participants in the amusement park, and selectively also between the multiple at home participants.

The present disclosure in one form provides a system, method and apparatus for simulating participation in an amusement ride where participants are playing a amusement park or theme park ride or activity game as part of the amusement ride. The players can be riding vehicles through a defined course and playing the game while the vehicles move through the course.

The system operates by gathering input from the amusement ride and game through sensors located along the path of the amusement ride, from events for players of the amusement park activity game and also by gathering user input from a remote participant through a user interface.

Different selected inputs are transmitted to a computer system where they are used to generate a display of the ride and/or game simulation, which reflects what is actually happening amusement park or theme park ride or activity at the amusement ride. The computer system also obtains data from play at home video game players. The display includes entities corresponding to participants who are playing at the amusement ride and also entities corresponding to simulated participants in the amusement ride and game who are playing the game remotely, for instance at home.

The amusement ride may be vehicles moving on a track. There can be a simulated shooting gallery type format that appears in a virtual sense to participants in the vehicle as it moves on the track. Sensors on the track record the position of the vehicles. This information is relayed to the computer system.

Commands received from the user interface can control a simulated vehicle in the display. By issuing commands through the user interface, a remote participant can navigate the simulated vehicle in the display and play a video game on a screen that depicts the environment where the actual vehicle in the amusement ride is traveling. In this way, the excitement of a highly interactive video game is combined with the amusement ride and participants in the ride.

The disclosure allows remote participants to effectively "compete" with the real participants in the amusement ride, selectively in a modified or a complete sense relative to the participant in the ride. A winner of a video game can be determined by gathering simulation results from a large number of geographically distributed players through a communication channel. In this way, potentially many remote participants can compete in a single simulation of a ride in an amusement park ride or activity.

The disclosure concerns a ride and game in a real world theme e park in which players play a laser-tag game, which involves shooting at targets along the ride. A real-time connection and interaction exists between players on the real world ride and players of a virtual game at home. The players at home can play individually or in teams with, or against, players of a virtual game at home. One or more video cameras are positioned on the ride so that the players at home can see and participate in the amusement park amusement park or theme park ride or activity action ride.

In this manner there are at least two different platforms of experience for the game interaction. The one platform is for participants having a real moving or mobile experience in a moving vehicle on a ride, and the other platform is for payer at home who have a relatively stationary experience in a virtual world while they operate the controls of a computer system.

It is an object of the disclosure to provide a new amusement system combining features from a ride attraction at a theme park or environment, and from a shooting game, together with new features at home to provide a more exciting and/or challenging experience for riders.

In a first aspect of the disclosure, an amusement system includes a vehicle moveable along a path. In a second separate aspect of the disclosure, a vehicle moves on a path through an attraction. Passengers are accommodated in passenger positions on a vehicle body. In a third aspect of the disclosure, movement of a first vehicle along a path is changed depending upon events occurring during the ride.

The additional feature, aspect or level of interaction is the play interaction with at home players who operate on a different virtual plane, experience, or environment, namely through a computer. Such at home participants interact with the amusement park players and selectively with other at home players.

Other objects and features of the disclosure will become apparent from the following detailed description taken in connection with the accompanying drawings. The drawings, however, are provided only for the purpose of illustration of the preferred embodiment, and should not be taken as a limitation of the disclosure.

DRAWINGS

The above-mentioned features and objects of the present disclosure will become more apparent with reference to the following description taken in conjunction with the accompanying drawings wherein like reference numerals denote like elements and in which:

FIG. 1 represents an amusement ride car with players shooting at targets with laser guns.

FIG. 2 represents a track for the amusement ride of FIG. 1.

FIG. 4 represents a different representation of the computerized system and network between an amusement park ride and game interacting with remote at home players of the game.

FIGS. 5 to 21 represent different screens for an electronic game related to the amusement ride.

DETAILED DESCRIPTION

Figure 3:
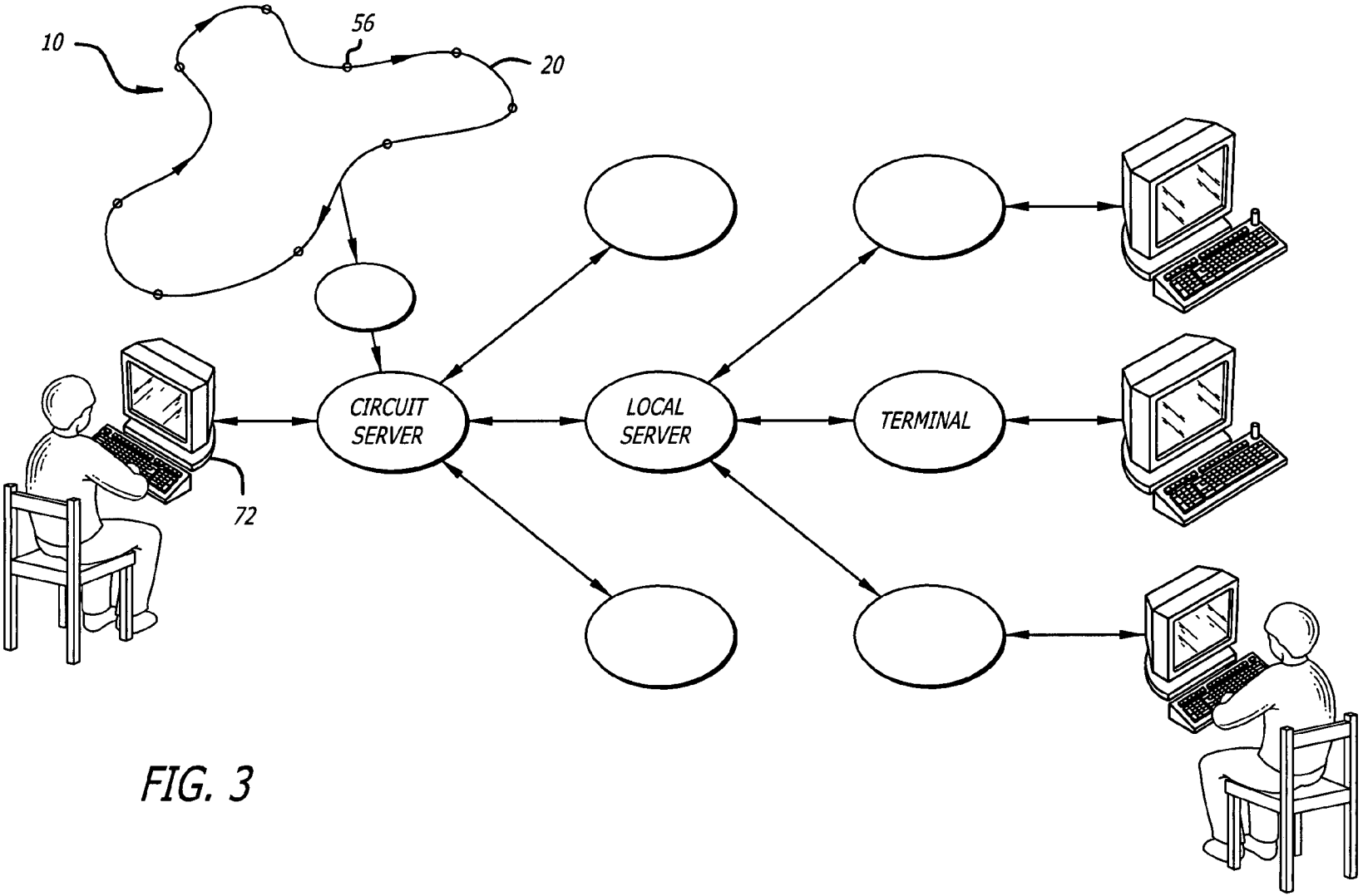
FIG. 3 represents a system for computer interaction between an amusement park ride and at home play of a game.
Figure 6:
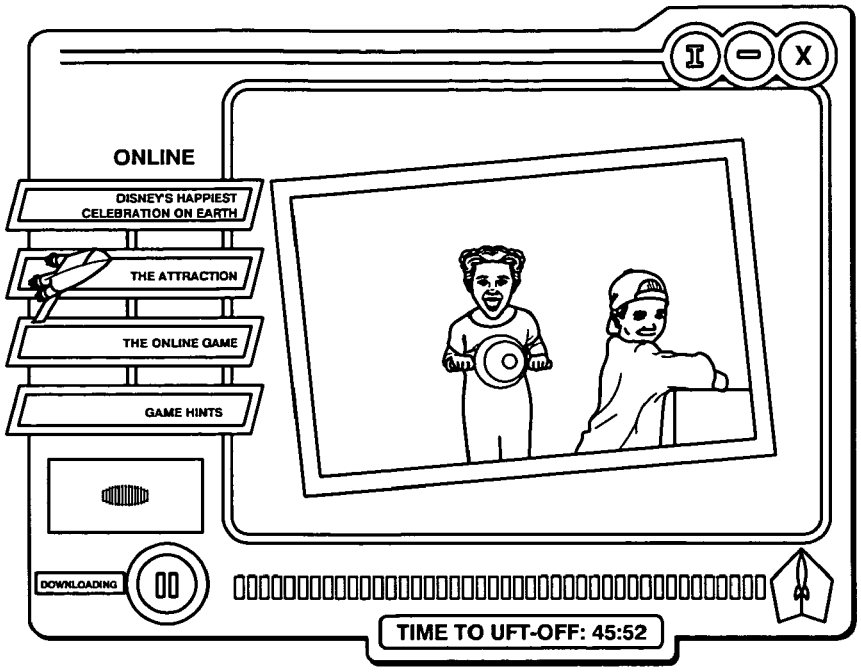
Figure 7:
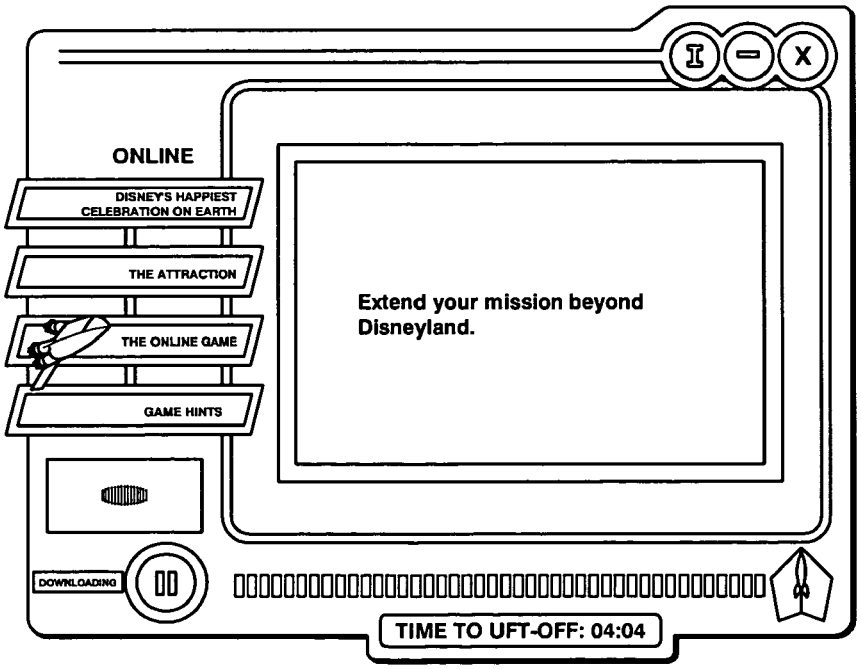
Figure 8:
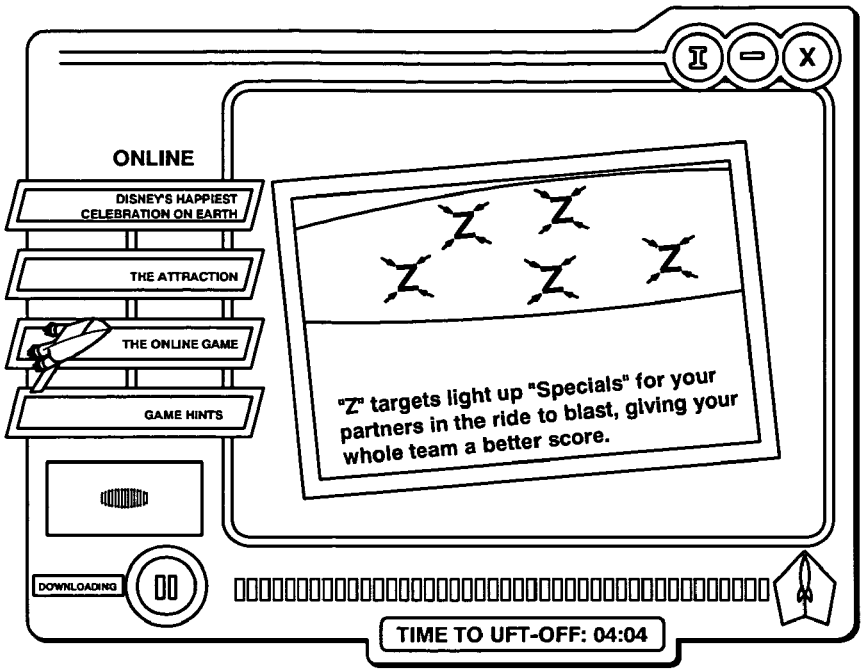
Figure 9:
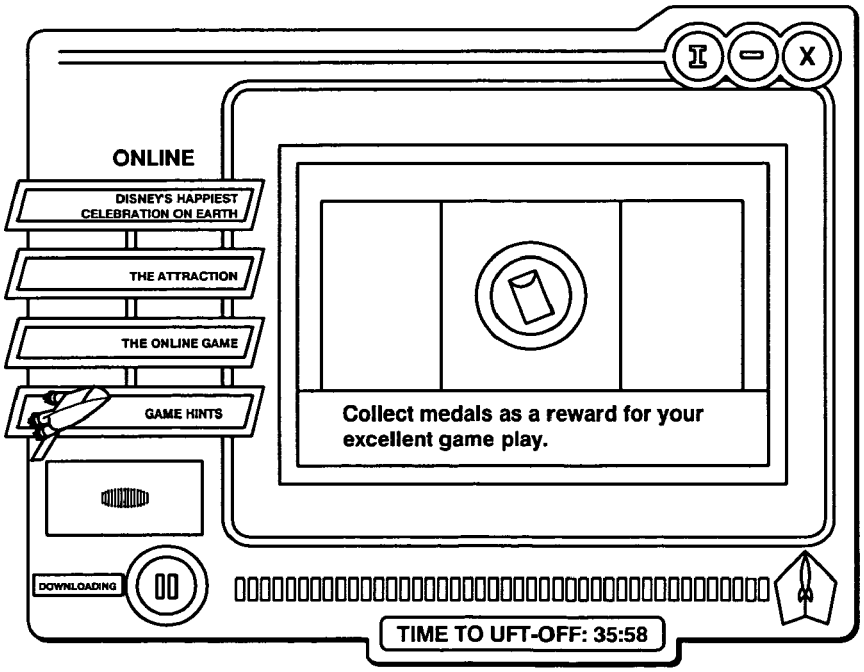
Figure 10:
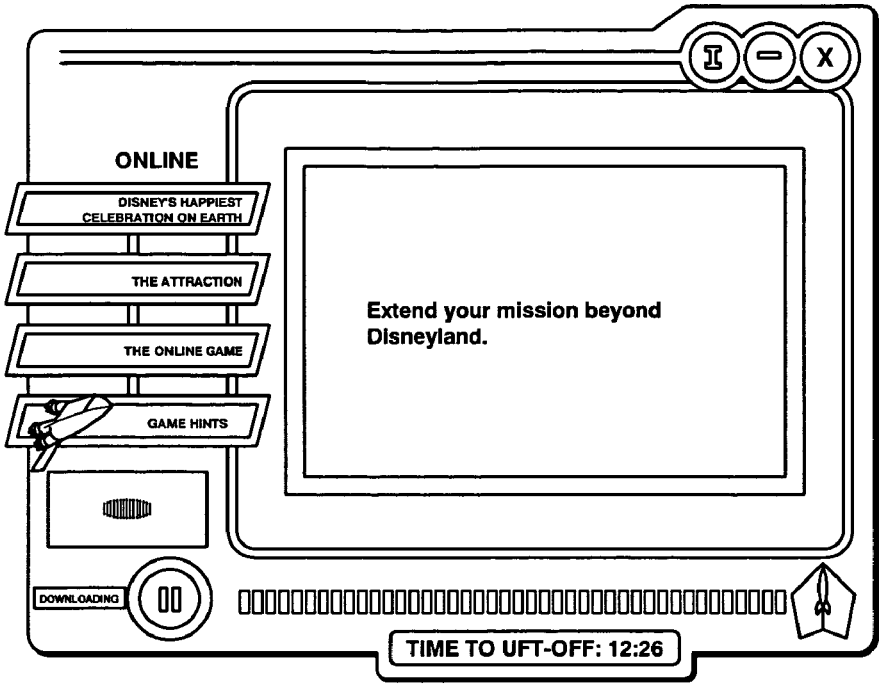
Figure 11:
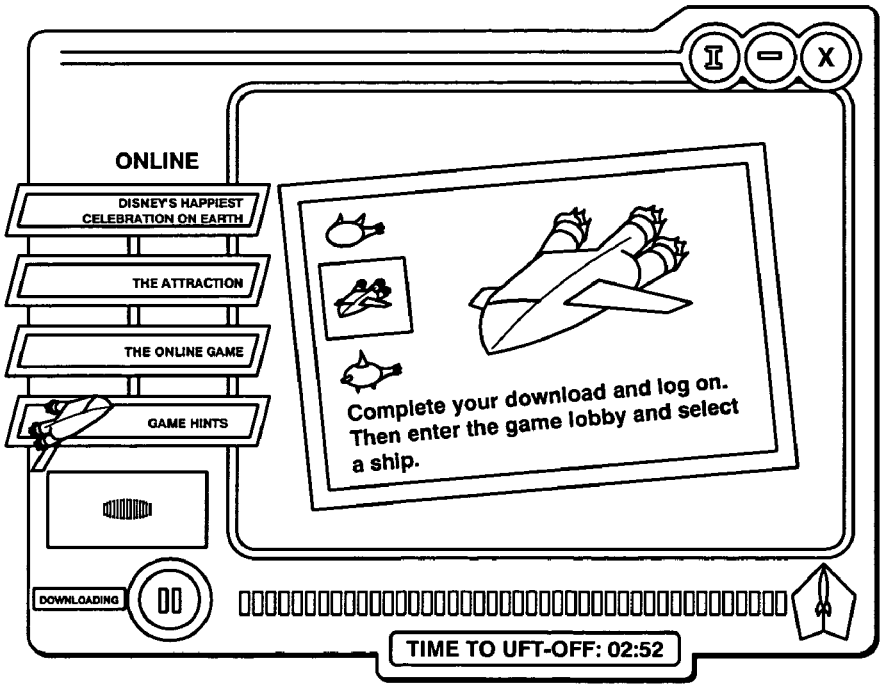
Figure 12:
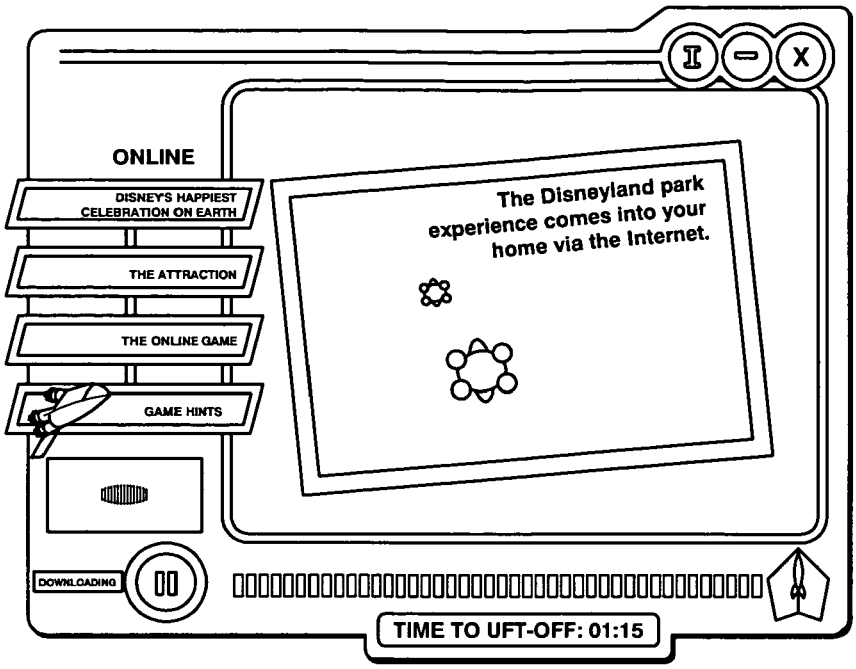
Figure 13:
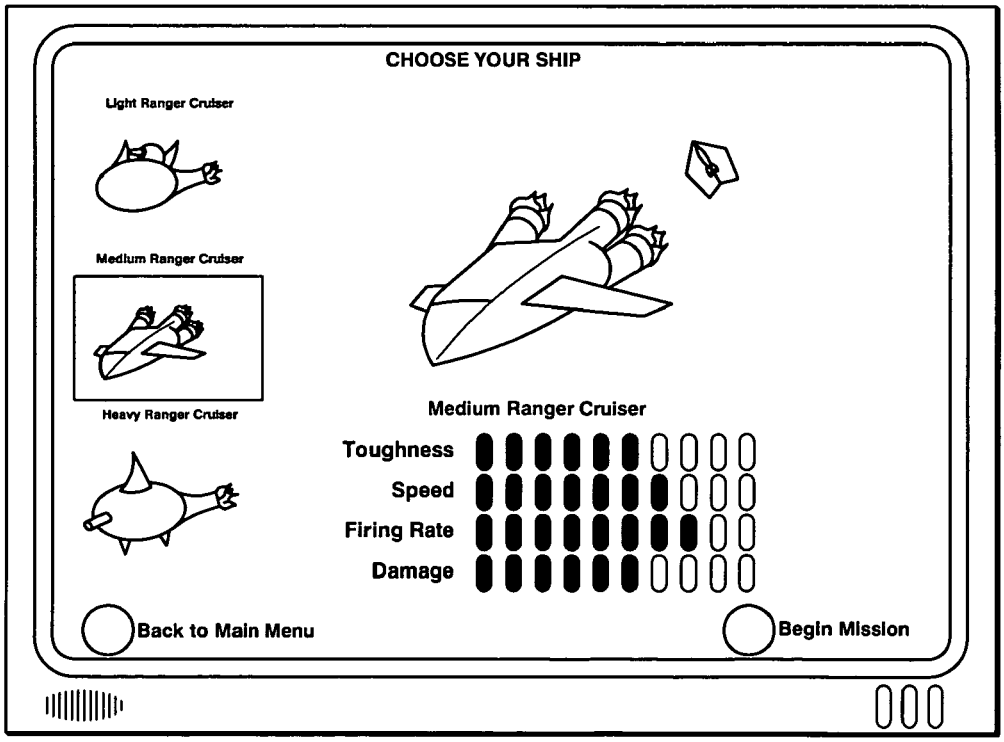
Figure 14:
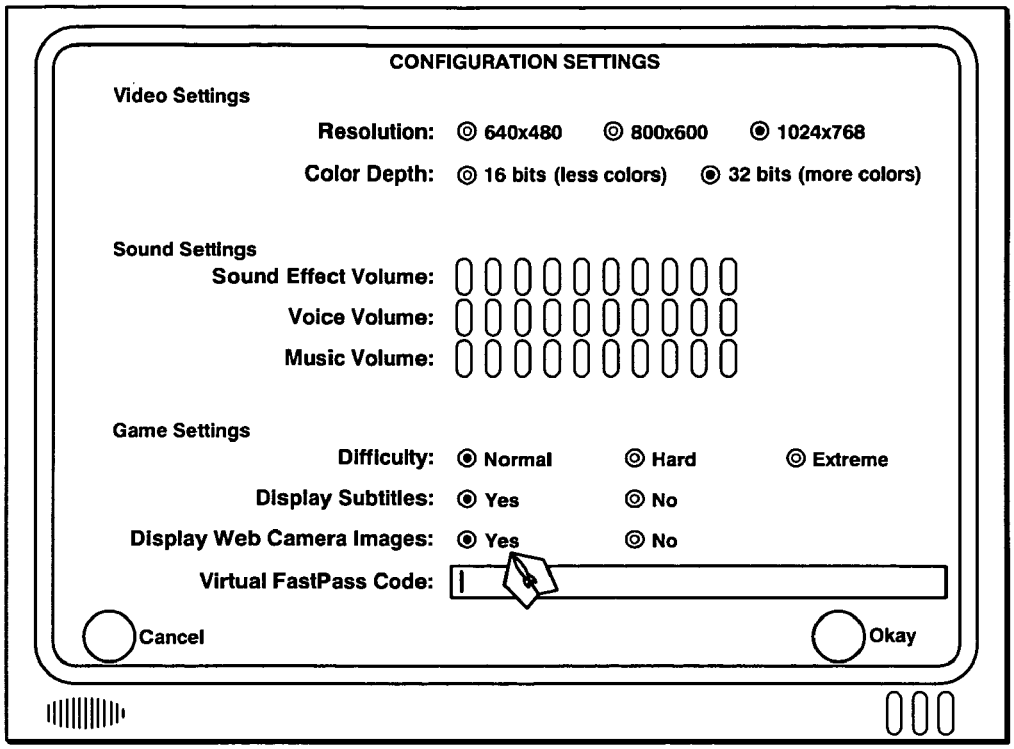
Figure 15:
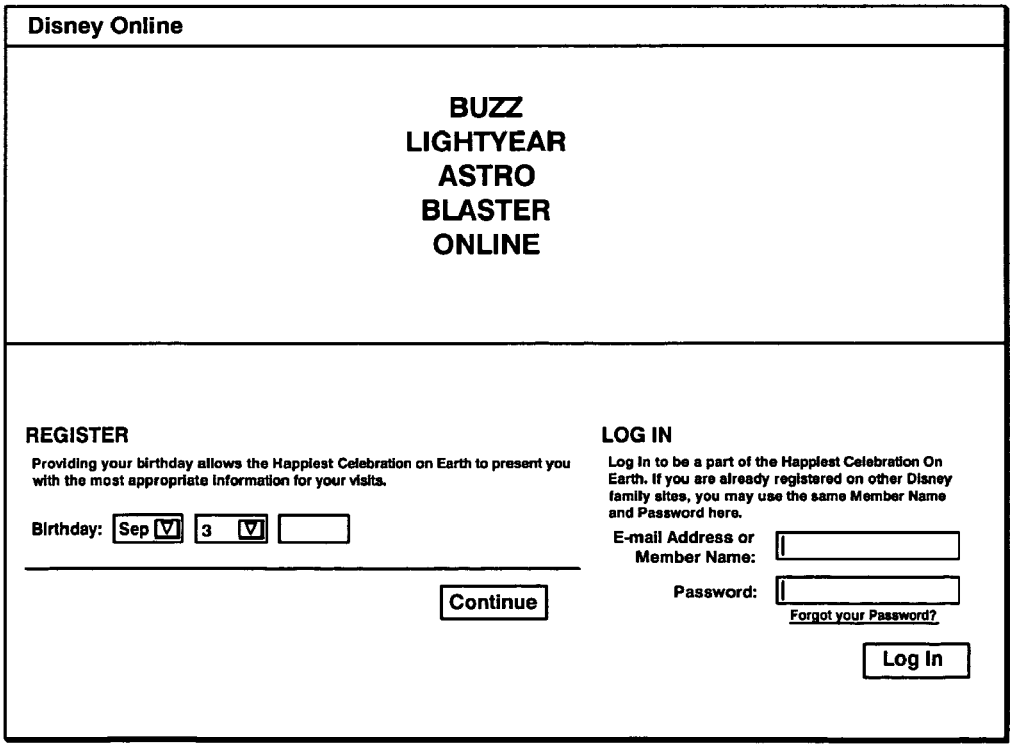
Figure 16:
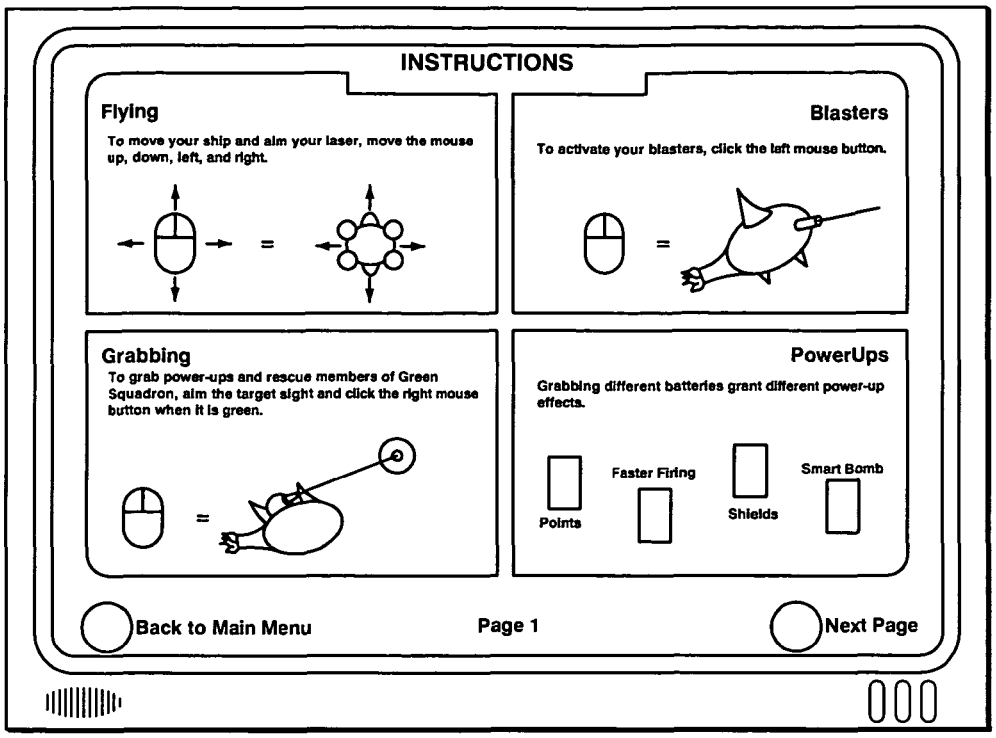
Figure 17:
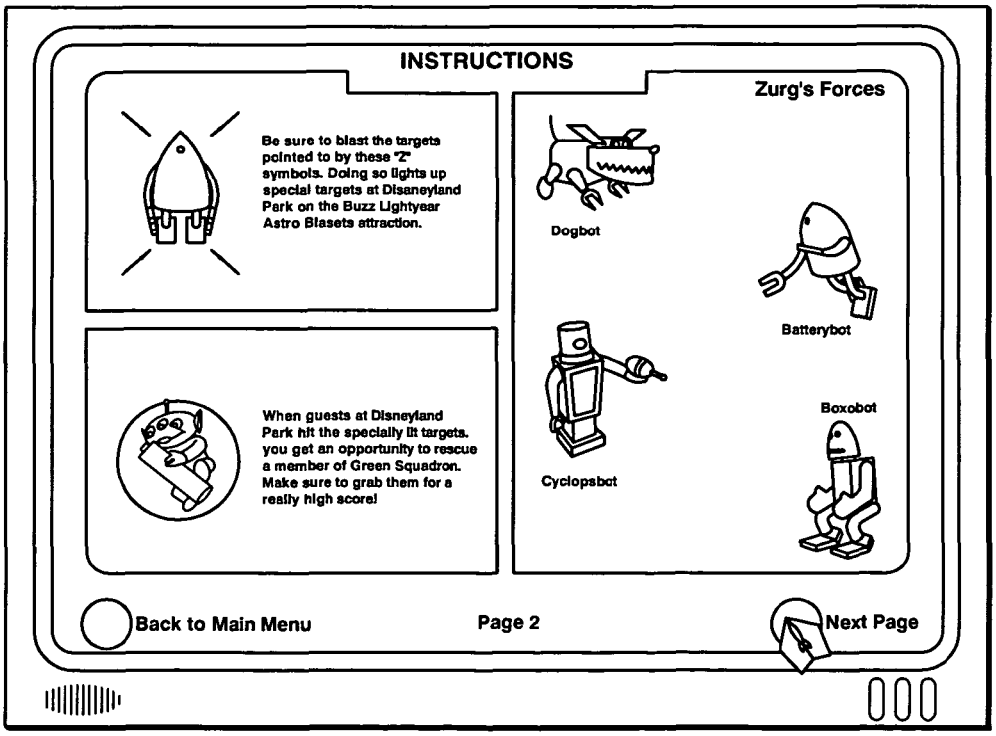
Figure 18:
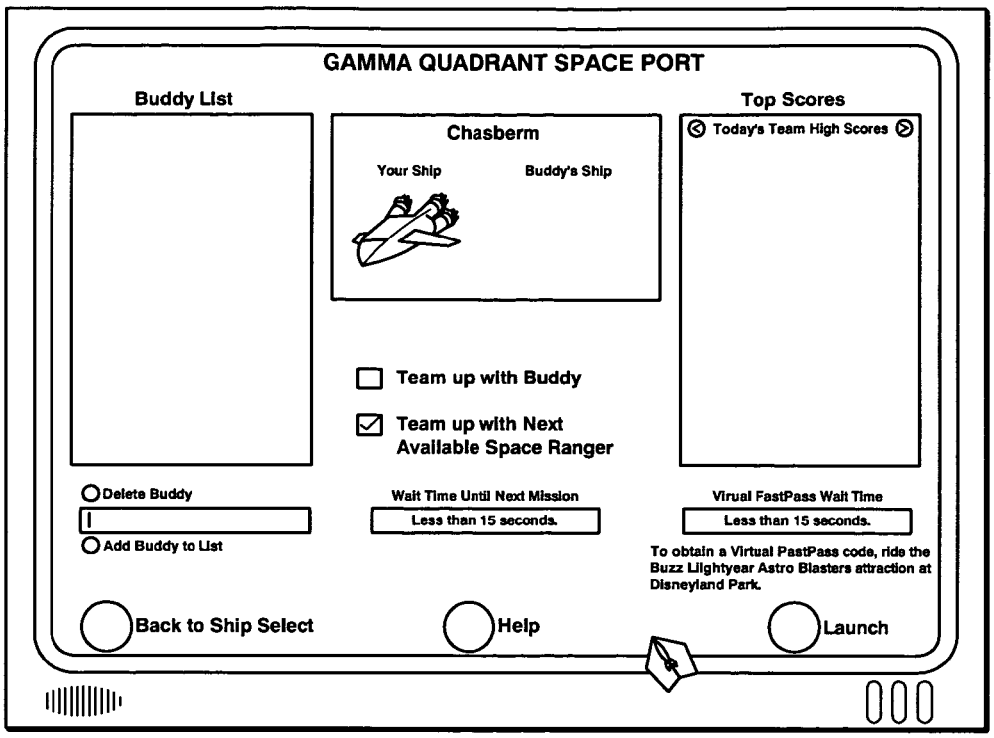
Figure 19:
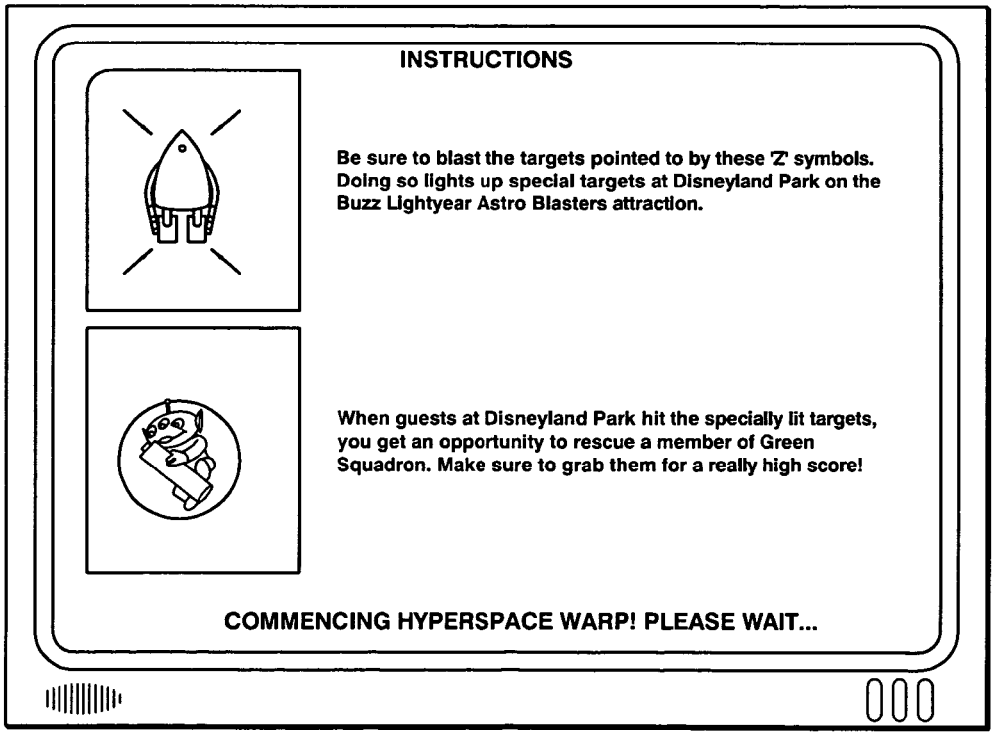
Figure 20:
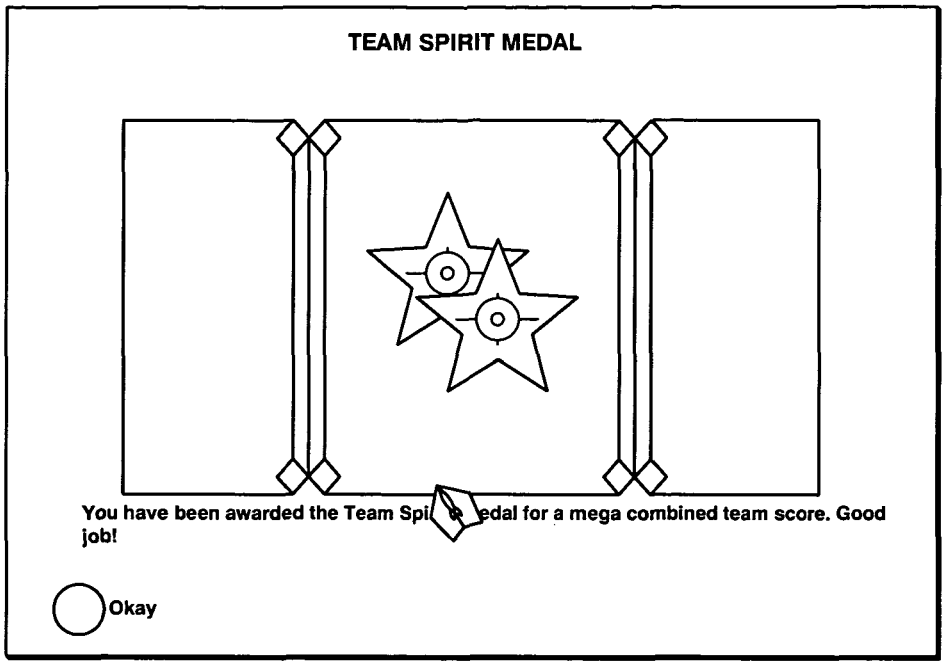
Figure 21:
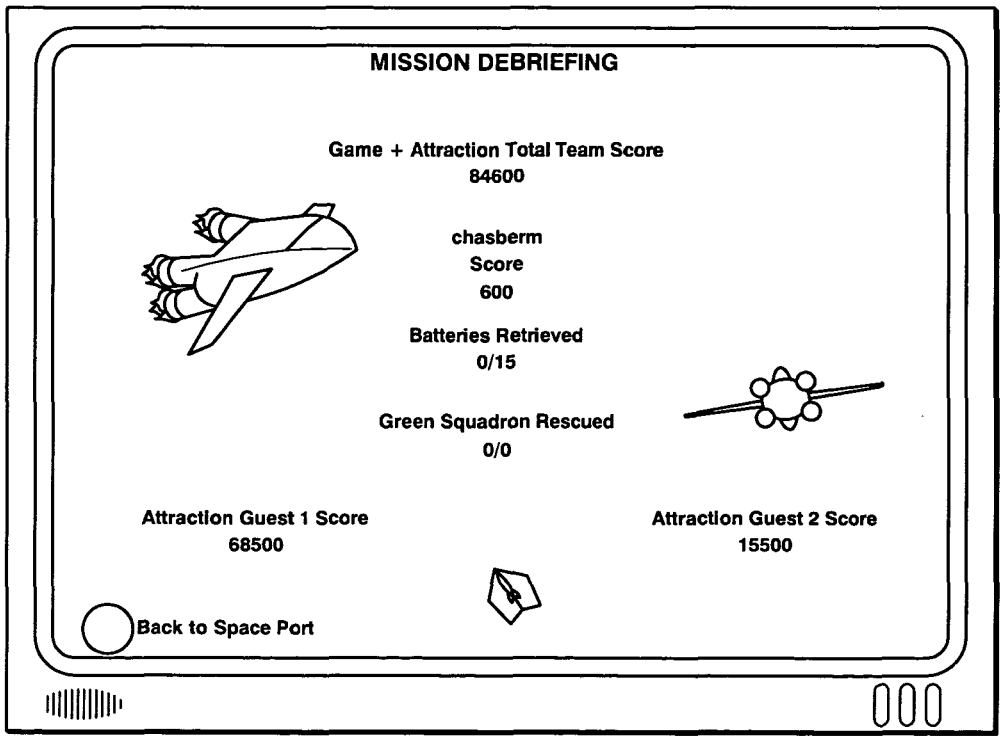

The disclosure is further described with reference to an example.

The system integrates an amusement ride and video game for simulating on a video game, events on a ride, and effecting interactions between the ride and video game.

There is a path for a ride, and vehicles move along the path. The vehicles including a chassis, a motor for moving the vehicles along the path, and a passenger position in the vehicles. There is a simulated weapon associated with the passenger position; and a target on the vehicles or adjacent to the path.

A detector detects an emission from the weapon as operated by a passenger of the ride; and a controller detects an emission from the weapon associated with the vehicles for determining whether the emission hits or misses the target.

The theme park event is connected through a communications link to a video game on a computer system. The video game on the computer system is remotely located relative to the ride. There is a display representing the ride, and the display has a plurality of simulated features corresponding to events in the ride, which correspond to the activities of at least one participant in the ride.

Event inputs are gathered from at least one sensor located at the ride; and these events are communicated to the video game. The display of the video game changes according to the sensed events. The video game display is also changed according to user inputs received from an interface at the video game.

Communications from the video game to the ride acts to permit changing characteristics of the ride according to the input from the user of the video game.

The simulated weapon is for shooting a light bream at moving targets.

In a computer system with a user interface there is a method for simulating interaction with an amusement park or theme park ride, activity or event. This method comprises generating a display representing the amusement park or theme park ride, activity or event in the computer system. The display includes a plurality of events corresponding to events experienced by participants in the amusement park or theme park ride, activity or event. The events are movable and changeable by both the participants in the theme park ride, activity or event and by persons operating the computer system.

The computer system is remotely located from the amusement park or theme park ride, activity or event theme park. The event input gathers data from at least one sensor located at the amusement park or theme park ride or activity or event. This is transmitted as an input or a modification of that input to the computerized system. This modifies the display of the computerized system according to the event input.

A user input is received from the user interface of the computerized system; and the display is modified according to the user input.

The display includes a display of a plurality of events corresponding to events experienced by participants in the amusement park or theme park ride, activity or event. These events are movable and changeable by both the participants in the theme park ride, activity or event and by persons operating the computer system.

Periodically synchronization of the display with a broadcast of the event input is possible from the amusement park or theme park ride or activity or event. As such the event input, which is broadcast is reflected in the display. The display appears to react to be substantially simultaneous with the broadcast of the event input to a user of the computer system.

Apparatus for simulating interaction with a amusement park or theme park ride, activity or event and a video game comprises at least one sensor for gathering event input from the amusement park or theme park ride or activity or event. There is a computer system including a user interface for playing the video game.

There is a display; and a communication network connects at least one sensor to the computer system for transferring the event input to the computer system. The computer system generates a display representing the amusement park or theme park ride or activity or event.

The display comprises the ability to display a plurality of events corresponding to activities of participants in the amusement park or theme park ride, activity or event and at least one video game player playing a game which relates to the amusement park or theme park ride or activity or event. The computer system periodically modifies the display according to the user input and the event input at the amusement park or theme park ride, activity or event. Positions in the display of the plurality of events relate to the participants and the video game user inputs.

A communications network permits communication between multiple participants in the amusement park or theme park ride or activity or event and multiple video game players at multiple different remote locations from each other and remote locations from the amusement park or theme park ride or activity or event. As such the multiple participants and the video game players can play with each other in relation to events at the amusement park or theme park ride or activity or event.

The disclosure is further described, as an example only, with reference to an attraction at Disneyland, namely the Buzz Lightyear ride (Disney, Disneyland, Buzz Lightyear, Evil Emperor Zurg are trademarks of Disney, Inc.).

Players in the amusement or theme park of Disneyland are riders in a car along a track. The participants play a laser-tag game shooting at targets in the ride. There is a real-time connection and interaction with people playing a similar game at home. The players at home may play individually or in teams with, or against, players on the actual ride. Through a video camera, the players at home can see and participate in the amusement park or theme park ride or activity action in the ride.

The user at home downloads the software first. These users then ride in a virtual spaceship that looks like the spaceship in the real ride. The at-home players have the ability to control some things that happen in the real world ride. For example, the at home users may be able to move something in the ride. Also, when the at-home player hits a virtual target, the real target inside the real ride may light up and change the scoreboard on the car in the actual ride.

Features of the game include for instance: Spin, Blast, Score, and Repeat. Elaboraton of these features for example means that a player in the amusement park ride or in the virtual video game experience can:

Blast off to "infinity and beyond" as a player joins Buzz Lightyear in an interactive and intergalactic battle against the Evil Emperor Zurg. This is further represented in the game as "The fate of the universe is in your hands as you pilot your Star Cruiser through the treacherous terrain while zapping enemy targets and racking up points."

Further the riders or virtual players can "Spin your Star Cruisers 360 degrees while you fire moveable, hand-held laser cannons."

Further the riders or virtual players can "Blast enemy targets and amass points, then compare your high-score with other Space Rangers or go for a personal best."

Further the riders or virtual players can "Climb up the Space Ranger ranks as your scores soar to astronomical heights each time you play."

Further the riders or virtual players can "Save the galaxy, then e-mail your Astro Blaster score home and wow your friends and family."

Further the riders or virtual players can "Join the battle online and team up with a Guest playing amusement park or theme park ride or activity in Disneyland® park."

The program which is downloaed on the remote computer system permtis for player at home to register to be a remote video game player who interacts with the game in the theme park. In this manner there is created an on-line player. The software can include different hints, tutorials, instructions and the like on how to play the on-line game.

Different awards, rewards and scores can be achieved by the on-line player and the particpant in the theme park. There can be a record of these sucesses and failures (misses) and like represented on the display as required.

The on-line player and the particpant in the theme park can choose different weapons and different targets for the ride activity and the video game respectively. There can be different levels of diffilculty and the participant and the players can choose according to different skill levels, and there can be different configurations and settings for the game.

It is also possible for players and or participants to set up teams and buddies so that they can enhance the game experience. It is possible for different players to play against each other even when there are no participants in the ride.

Hardware and System

A control computer in a control room, is linked to track sensors 56 along the paths 20 to monitor the positions of the vehicles 30, and to control various events occurring in the amusement system 10. The control computer 72 is also linked to the animated FIGS. 60 and to the detectors 62 to control movement of the animated FIGS. 60 and moving targets 64, to detect when a target is hit, and to record a score for the player or vehicle scoring the hit. The control computer 72 is also linked to the vehicle computer 54, either via the bus bar 58, or through wireless techniques. As shown in FIG. 2, multiple first and second vehicles move along spaced apart on the track.

In use, riders board the vehicles 30 and 32 at the load/unload platform 24. The vehicles 30 and 32 then move into the game room or scene 18. Various animated figures move about in the game room or scene 18, with some moving towards the vehicles 30 and 32 to seemingly threaten the riders. The riders shoot at the animated FIG. 60 or at the fixed and moving targets 61 and 64, using the weapons 50. The light beam emitted from each weapon 50 is preferably modulated, so that the detectors 62 and control computers 72 can identify each weapon 50 and the rider who successfully "hit" any of the targets or figures.

The control computer 72 preferably provides instructions to the vehicle computer 54, which control the vehicle, drive motor 49. For example, if in one or more of the game rooms or scenes 18, the riders in the "first" vehicle 30 outscore the riders in the "second" vehicle 32 by a preset amount (scoring achieved by successfully hitting a target with a light beam from the weapon 50) then the control computer 72 instructs the vehicle computer 54 to change a movement profile of vehicle by causing the vehicle 2 to slow down, by slowing the drive motor 49. The control computer 72 and vehicle computer 54 control all aspects of the amusement system, such as vehicle, animated figure, and target movement and position, sound and lighting effects, simulated gun and scoring characteristics.

Other aspects of the ride, in addition to vehicle movement, can also be changed based on the occurrence or non-occurrence of an event. The vehicle computer 54 and the control computer 72 communicate with each other in real time. Any device or activity controlled by the vehicle computer 54 or the control computer 72 (e.g., vehicle movement; guns; targets; animation; sound; lighting; special effects, etc.) can be started, stopped, or changed, based on preprogrammed instructions, events occurring during the ride, or both.

FIG. 4 is a functional block diagram of functional components in a system for simulating participation with an amusement park or theme park ride, event activity or game. Sensors 110 at various locations in an amusement park or theme park ride, activity or event 100 gather data to be used in remote simulations of amusement park or theme park ride, activity or event 100. These sensors 110 connect to preprocessor 120, which assembles the data collected from sensors 110 for transmission across a network 130. The network 130 connects the preprocessor 120 to a collection of remote computer systems 140, 142 and 144. These remote computer systems 140, 142 and 144 contain separate amusement park or theme park ride, activity or events simulations 150, 152, and 154, respectively. Game players 160, 162, and 164, sit at computers 140, 142, and 144 and interact with the amusement park or theme park ride, activity or events simulations 150, 152, and 154. For instance the player 160 interacts with the amusement park or theme park ride, activity or events simulation 150 on the remote computer system 140. The player 162 interacts with amusement park or theme park ride, activity or events simulation 152 on remote computer system 142. The player 164 interacts with amusement park or theme park ride, activity or events simulation 154 on remote computer system 144.

The amusement park or theme park ride, activity or event 100 can be any type of competitive or participatory event in which remote participants can participate. In the example of this disclosure this is a shooting gallery where there are laser type guns directed at targets along ride. A variety of sensors 110 are located within amusement park or theme park ride, activity or event 100. The position sensor 200 detects the position of a vehicle or a participant in amusement park or theme park ride, activity or event 100. There can be position and location sensors, speed sensors for participants in amusement park or theme park ride, activity or event 100. There can be target tally sensors in the form of internal monitors of tallies of targets hit by laser guns of different participants at the amusement park ride or activity. Other types of sensors collect sensory data, such as light sensors that can measure the intensity of lighting at different areas of the amusement park or theme park ride, activity or event 100.

One or more video cameras can gather video images from different locations within amusement park or theme park ride, activity or event 100. Video cameras can be mounted on cars or above the track of the amusement park or theme park ride, activity or event. Multiple video cameras are located at various strategic positions with the track of the amusement park or theme park ride, activity or event 100. Participants in the amusement park or theme park ride, activity or event 100 may wear helmet cameras, which provide participant perspectives on amusement park or theme park ride, activity or event 100.

A microphone can monitor sound from amusement park or theme park ride, activity or event 100. This sound can be added to amusement park or theme park ride, activity or events simulation 150 to enhance the reality of amusement park or theme park ride, activity or events simulation 150. For example, a large collection of microphones located at strategic positions within amusement park or theme park ride, activity or event 100 creates a sound mapping of amusement park or theme park ride, activity or event 100. This sound mapping is used to accurately reproduce sounds at different locations as a simulated participant navigates within amusement park or theme park ride, activity or event 100.

The sensors connect to the preprocessor. The preprocessor 120 performs a number of operations on the data gathered through sensors 110, including, for example: extraction of position information from a video signal through image recognition software, and compression of data collected through sensors 110 in preparation for transport across network 130 to remote computer systems 140, 142 and 144. The preprocessor 120 alternatively may have limited computing power, and provides simple data routing elements, which transmit raw data from sensors 110 to computers 140, 142 and 144. Alternatively the preprocessor 120 provides compression and filtering functions, requiring special purpose hardware for digital signal processing, as well as a central processing unit connected to a full computational system. The preprocessor 120 can also buffers data from sensors 110. This allows data collected from sensors 110 to be assembled and temporarily stored before transmission across network 130. The preprocessor 120 can include dedicated hardware to convert analog signals from sensors 110 into digital form for transport over the network 130.

The network 130, which can include a WAN, LAN or Internet connections transports data from preprocessor 120 to computers 140, 142 and 144. The network 130 comprises a computer network, such as the Internet, used to transmit a stream of data from preprocessor 120 to remote computer systems 140, 142 and 144. This stream of data includes a digitized video signal. The network 130 can include a wireless computer network, and/or a broadcast television network, which transmits a video signal and other data, and/or a dedicated cable television network, and/or a collection of telephone lines.

The remote computer system 140 contains software and a program to simulate an amusement park or theme park ride, activity or event simulation 150. The remote computer system 140 can include a central processing unit (CPU) connected to bus, connected to an appropriate disk drive, display and memory. The memory contains executable computer code and data 340 for the amusement park or theme park ride, activity or events simulation 150. The bus also connects the CPU to a number of data input devices including, for instance a mouse, joystick, keyboard, a microphone with voice recognition software, and/or a video camera with image recognition software.

In some forms, at least part of the virtual amusement park or theme park ride, activity or event simulation takes place with at a central computer system, and other parts of the amusement park or theme park ride, activity or event simulation 150, 152, and 154, take place in remote computer systems 140, 142 and 144. In another system, the entire amusement park or theme park ride, activity or event simulation takes place at central computer system, and remote computer systems 140, 142 and 144 function as display and data input devices, such as computer terminals. According to another embodiment of the present disclosure, the amusement park or theme park ride, activity or event simulation is divided into multiple pieces and these pieces are executed across a number of nodes of a distributed computing system.

An amusement park or theme park ride, activity or event simulation 150 operates with a computer system 140 to generate a display of an amusement park or theme park ride, activity or event 100, which is viewed by player 160. Event 100 is reflected through sensors 110. The event input is used to modify display to properly reflect the current state of amusement park or theme park ride, activity or event 100. The computer system 140 receives "user" input from player 160. This user input is used to update the display to reflect the effect of user commands on an amusement park or theme park ride, activity or event simulation 150.

The display of the amusement park or theme park ride, activity or event 100 contains data corresponding to both simulated participants and real participants in the amusement park or theme park ride, activity or event 100. Rules encoded in the amusement park or theme park ride, activity or event simulation 150 govern how the simulated and theme park entities interact with each other in amusement park or theme park ride, activity or event simulation 150. For example, a rule specifies that a simulated entity cannot occupy the same physical space as a real entity. If a player attempts to move a simulated entity into the same physical space as a real entity, the simulated entity will move a close as possible to the real entity, but will be prevented from occupying the same physical space as the real entity in amusement park or theme park ride, activity or event simulation 150.

Different types of interactions are regulated by amusement park or theme park ride, activity or event simulation 150: These can be interactions between simulated participants; and interactions between participants at the theme park event or game and simulated participants. There is flexibility in specifying rules governing interactions between simulated participants, and the amusement park or theme park ride, activity or event simulation participants. The game designer can develop a customized set of rules to govern interactions between participants in the amusement park or theme park ride, activity and/or event simulation 150.

Amusement park or theme park ride, activity or event simulation 150 is synchronized with amusement park or theme park ride, activity or event 100 so that display of amusement park or theme park ride, activity or event simulation 150 appears to be substantially simultaneous with amusement park or theme park ride, activity or event 100 to a player 160 of amusement park or theme park ride, activity or event simulation 150. Synchronization between amusement park or theme park ride, activity or event 100 and amusement park or theme park ride, activity or event simulations 150, 152 and 154 at remote computer systems 140, 142 and 144, is accomplished in a number of ways. There can be television signal transmissions of information between amusement park or theme park ride, activity or event 100 and computers 140, 142 and 144, and synchronization information is encoded in the television signal by modulation or by transmitting it during the vertical blanking interval (VBI) of the television signal. Periodic transmissions over the computer network 130 are used to synchronize amusement park or theme park ride, activity or event simulation 150 with amusement park or theme park ride, activity or event 100.

There can be a facility to collect scoring information from amusement park or theme park ride, activity or event simulations 150, 152 and 154. A communication channel through network 130 is used to gather scoring information from remote amusement park or theme park ride, activity or event simulations 150, 152, and 154 at a central location. The scoring information is tabulated, and competitors can thus be determined for remote simulations and participants at the theme park.

In one embodiment, the video game in the system and method described above is played at home remotely from the theme park. In another embodiment, the video game in the system and method described above is played in the theme park itself. One of ordinary skill in the art will recognize that the video game can be played in any location with a gaming console and a video display.

Thus, a novel amusement system has been shown and described. Various modifications may of course be made without departing from the spirit and scope of the disclosure. The disclosure, therefore, should not be limited, except to the following claims, and their equivalents. While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A system of integrating an amusement ride and a video game, and providing interactions between the amusement ride and the video game, the system comprising:

the amusement ride having a vehicle movable along a path, a passenger position in the vehicle;

a simulated weapon associated with the passenger position;

a target;

a detector for detecting an emission from the simulated weapon as operated by a passenger of the vehicle;

a controller for determining whether the emission hits or misses the target;

a communications link to the video game on a computer system, the video game on the computer system being remotely located relative to the amusement ride and comprising a display representing the amusement ride, the display having a plurality of simulated features corresponding to events at the amusement ride which correspond to the activities of the passenger of the vehicle, and wherein the computer system is configured to gather event inputs from at least one sensor associated with the amusement ride and communicate the event inputs to the video game, and to change the display of the video game according to the event inputs gathered from the at least one sensor, and further configured to change the video game display according to user inputs received from an interface of the video game, and further configured to communicate the user inputs from the video game to the amusement ride for changing characteristics of the amusement ride according to the user inputs from a user of the video game.

2. The system of claim 1 wherein the simulated weapon is shooting a light bream at moving targets.

3. The system of claim 2 further comprising a communications network for providing the communication link between the passenger in the vehicle and multiple video game players at multiple different remote locations from each other and remote locations from the amusement ride, such that the passenger and the video game players can play with each other in relation to the events at the amusement ride.

4. The system of claim 1 further comprising a communications network for providing the communication link between the passenger in the vehicle and multiple video game players at multiple different remote locations from each other and remote locations from the amusement ride, such that the passenger and the video game players can play with each other in relation to the events at the amusement ride.

5. A method of providing interactions between an amusement ride and a video game, the method comprising:

detecting activities by a passenger of a vehicle of the amusement ride, the vehicle being movable along a path;

communicating information relating to the activities of the passenger to a video game on a computer system remotely located relative to the amusement ride, the computer system comprising a display representing the amusement ride, the display having a plurality of simulated features corresponding to events at the amusement ride which correspond to the activities of the passenger of the vehicle;

receiving user inputs received by an interface of the video game from the computer system; and changing characteristics of the amusement ride according to the user inputs from the user of the video game.

6. The method of claim 5 wherein the activities by the passenger include shooting a light bream at moving targets using a simulated weapon in the vehicle.

7. The method of claim 5 further comprising:

communicating the information relating to the activities of the passenger to a second video game on a second computer system remotely located relative to the amusement ride, the second computer system comprising a display representing the amusement ride, the display having a plurality of simulated features corresponding to events at the amusement ride which correspond to the activities of the passenger of the vehicle and the user inputs from the first computer, receiving second user inputs received by an interface of the second video game from the second computer system; and changing characteristics of the amusement ride according to the second user inputs from a second user of the second video game.

8. A system for providing interactions between an amusement ride and a video game, the system comprising:

at least one sensor for detecting activities by a passenger of a vehicle of the amusement ride, the vehicle being movable along a path;

a controller for communicating information relating to the activities of the passenger to a video game on a computer system remotely located relative to the amusement ride, the computer system comprising a display representing the amusement ride, the display having a plurality of simulated features corresponding to events at the amusement ride which correspond to the activities of the passenger of the vehicle;

the controller configured to receive user inputs received by an interface of the video game from the computer system, and further configured to change characteristics of the amusement ride according to the user inputs from the user of the video game.

9. The system of claim 8 wherein the activities by the passenger include shooting a light bream at moving targets using a simulated weapon in the vehicle.

10. The system of claim 8, wherein:

the controller is further configured to communicate the information relating to the activities of the passenger to a second video game on a second computer system remotely located relative to the amusement ride, the second computer system comprising a display representing the amusement ride, the display having a plurality of simulated features corresponding to events at the amusement ride which correspond to the activities of the passenger of the vehicle and the user inputs from the first computer; and the controller configured to receive second user inputs received by an interface of the second video game from the second computer system, and further configured to change characteristics of the amusement ride according to the second user inputs from a second user of the second video game.

* * * * *